US006239706B1

(12) United States Patent
Yoshiike et al.

(10) Patent No.: US 6,239,706 B1
(45) Date of Patent: May 29, 2001

(54) IN-BED STATE DETECTION SYSTEM

(75) Inventors: Nobuyuki Yoshiike, Ikoma; Shigeyuki Inoue, Katano; Kazuhiko Hashimoto, Moriguchi, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/154,493

(22) Filed: Sep. 16, 1998

(30) Foreign Application Priority Data

Sep. 17, 1997 (JP) ..... 9-251981

(51) Int. Cl.[7] ..... G08B 23/00

(52) U.S. Cl. ..... 340/573.4; 340/575; 340/686.1

(58) Field of Search ..... 340/573.1, 573.4, 340/575, 686.1, 286.07, 666; 600/484, 595, 459; 177/144, 210 R

(56) References Cited

U.S. PATENT DOCUMENTS

| | | | | |
|---|---|---|---|---|
| 4,179,692 | | 12/1979 | Vance | 340/573.1 |
| 4,263,586 | * | 4/1981 | Nicholas | 340/568 |
| 4,320,766 | | 3/1982 | Alihanka et al. | 600/484 |
| 4,633,237 | * | 12/1986 | Tucknott et al. | 340/573.4 |
| 4,638,307 | * | 1/1987 | Swartout | 340/666 |
| 4,657,026 | | 4/1987 | Tagg | 600/534 |
| 4,738,264 | * | 4/1988 | Orlando | 600/484 |
| 5,276,432 | * | 1/1994 | Travis | 340/573.4 |
| 5,479,939 | * | 1/1996 | Ogino | 600/595 |
| 5,590,650 | | 1/1997 | Genova | 600/301 |
| 5,853,005 | * | 12/1998 | Scanlon | 600/459 |

FOREIGN PATENT DOCUMENTS

| | | |
|---|---|---|
| 4-30504 | 3/1992 | (JP) . |
| 4-153799 | 5/1992 | (JP) . |

OTHER PUBLICATIONS

European Search Report dated Jul. 13, 1999 for EP 98 11 7439.

* cited by examiner

*Primary Examiner*—Van T. Trieu
(74) *Attorney, Agent, or Firm*—Ratner & Prestia

(57) ABSTRACT

An in-bed state detection system includes: a load detection section for detecting a load applied to a bed and providing a corresponding load signal; a determination section for determining an in-bed state based on the load signal; and a transmission section for transmitting a result of the determination.

11 Claims, 7 Drawing Sheets

IN-BED STATE DETECTION SYSTEM

BACKGROUND OF THE INVENTION

1. Field of the Invention

The present invention relates to an in-bed state detection system for detecting how a human is situated in a bed.

2. Description of the Related Art

In hospitals, facilities for the aged, etc., it is often necessary to know whether a person is in bed or out of bed and wandering somewhere, for example. Therefore, nurses or the like may be required to make rounds to rooms accommodating one or more beds.

Japanese Laid-open Utility Model Publication No. 4-30504 discloses an apparatus for monitoring whether or not a person is in bed. This publication discloses a plurality of pyroelectric infrared sensors and thermopiles which are disposed by the bedside and horizontally to the pillow.

However, there has not been proposed any effective method which is intended for a high-quality care based on various states of sleep of a patient for detecting whether the patient (hospitalized or otherwise) on a bed is fast asleep or lacking sleep, or in an abnormal state (e.g., having strokes of a certain disease, convulsion, etc.).

SUMMARY OF THE INVENTION

An in-bed state detection system according to the present invention includes: a load detection section for detecting a load applied to a bed and providing a corresponding load signal; a determination section for determining an in-bed state based on the load signal; and a transmission section for transmitting a result of the determination.

In one embodiment of the invention, the load detection section is provided between the bed and a floor on which the bed is placed.

In another embodiment of the invention, the in-bed state detection system further includes means for indicating the in-bed state via sounds and/or light.

In still another embodiment of the invention, the transmission section includes an electromagnetic signal transmitter and an electromagnetic signal receiver, the electromagnetic signal transmitter being disposed on the bed, and the electromagnetic signal receiver being disposed at a location other than on the bed.

In still another embodiment of the invention, the determination section differentiates the load signal by time and determines the in-bed state based on an output intensity and temporal distribution of a signal resulting from differentiation of the load signal.

In still another embodiment of the invention, the determination section determines the in-bed state based on an amplitude and a frequency of the load signal.

In still another embodiment of the invention, the in-bed state is at least one of a "fast asleep" state, a "lacking sleep" state, a "convulsive" state, a "frantic" state, and a "periodic strokes" state.

In still another embodiment of the invention, the in-bed state detection system further includes a central control unit for receiving the result of the determination transmitted from the transmission section and displaying the result, the central control unit being disposed in a room other than a room in which the bed is placed.

Thus, the invention described herein makes possible the advantage of providing an in-bed state detection system for detecting how a human is situated in a bed.

This and other advantages of the present invention will become apparent to those skilled in the art upon reading and understanding the following detailed description with reference to the accompanying figures.

DESCRIPTION OF THE PREFERRED EMBODIMENTS

EXAMPLE 1

An in-bed state detection system 10 according to a first example of the present invention will be described with reference to the figures.

Figure 1:
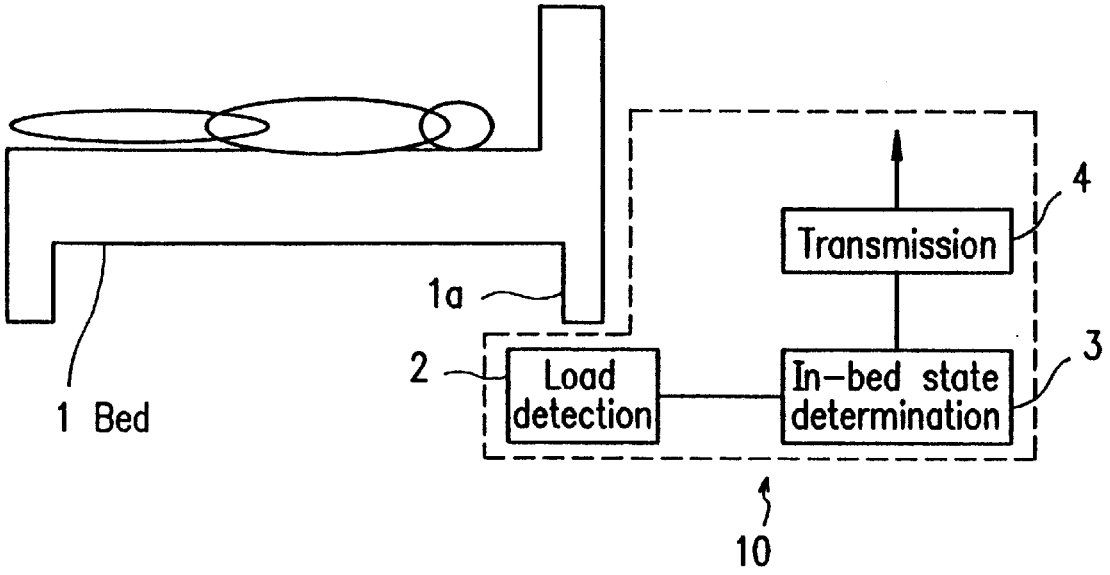
FIG. 1 is a diagram illustrating an in-bed state detection system according to Example 1 of the present invention.

FIG. 1 is a diagram illustrating the in-bed state detection system 10. The in-bed state detection system 10 includes a load detection section 2, an in-bed state determination section 3, and a transmission section 4. The load detection section 2, which detects the load applied on at least one leg 1*a* at the head side of a bed 1, is disposed between that leg and the floor. A load signal representing the load detected by the load detection section 2 is sent to and analyzed by the in-bed state determination section 3. The result of analysis is sent by the transmission section 4 to the outside of the room in which the bed 1 is placed.

Figure 2:
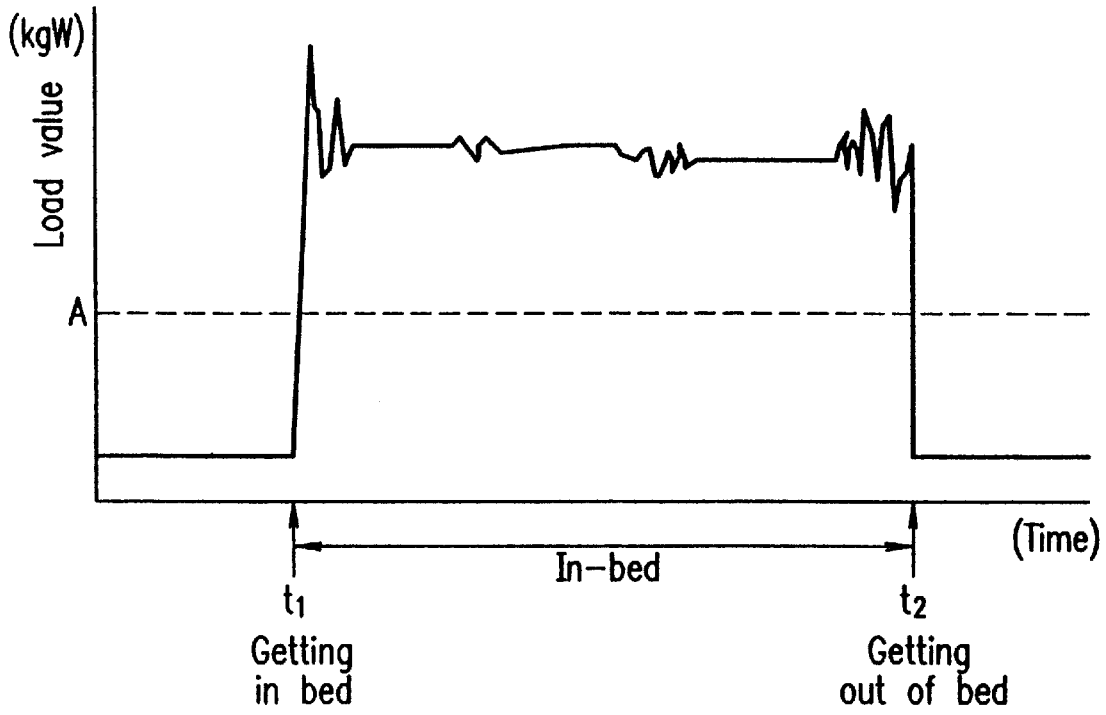
FIG. 2 is a graph illustrating a load applied versus time.

FIG. 2 is a graph illustrating the load applied to a leg of a bed versus time. Specifically, FIG. 2 illustrates a person getting in bed at time t1 and getting out of bed at time t2.

The in-bed state determination section 3 determines whether a person is in bed or out of bed based on the load signal detected by the load detection section 2. If the detected load signal is equal to or greater than a threshold value A shown in FIG. 2, the in-bed state determination section 3 determines that the person is in bed; if the detected load signal is smaller than a threshold value A shown in FIG. 2, the in-bed state determination section 3 determines that the person is out of bed.

Furthermore, the in-bed state determination section 3 determines the in-bed state of a person who is in bed.

Herein, the in-bed state refers to a state of a person who is in bed, e.g., "fast asleep", "lacking sleep", "convulsive", "frantic (i.e., under an unperiodic stroke)", or "periodic strokes".

Figure 3:
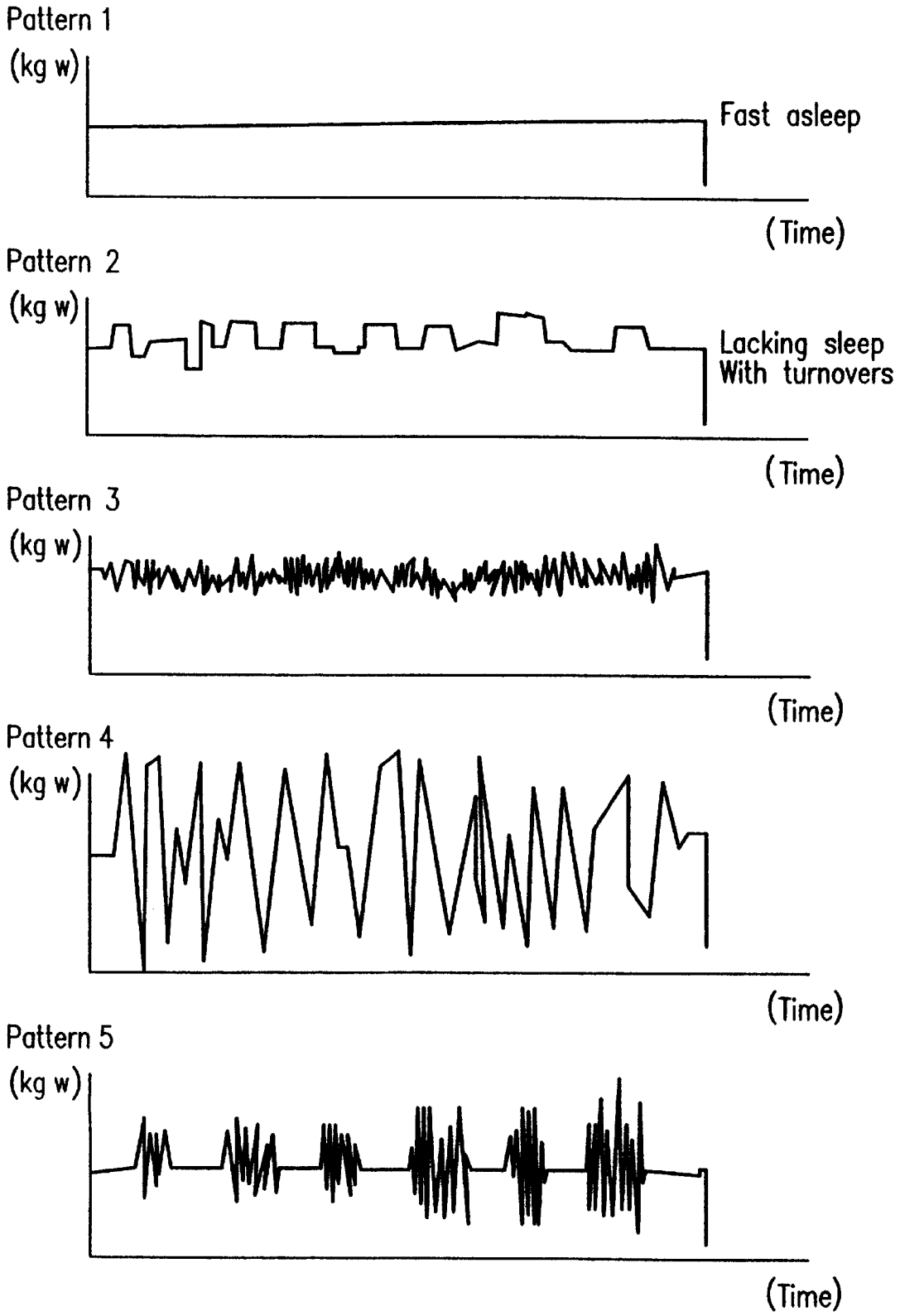
FIG. 3 is a set of graphs illustrating loads applied versus time in various in-bed states.

FIG. 3 is a set of graphs illustrating loads applied versus time in various in-bed states.

In FIG. 3, pattern 1 shows a "fast asleep" state, where the body of the person in bed is in substantially no motion. Pattern 2 shows a "lacking sleep" state, where the magnitude of the detected load signal undergoes a periodic variation (i.e., the person in bed keeps repositioning through turning over, etc.). Pattern 3 shows a "convulsive" state, where the person in bed is having a convulsion (i.e., the body of the person is making minute movements). Pattern 4 shows a "frantic" (under an unperiodic stroke) state, where the person in bed is having an unperiodic stroke or moving about violently. Pattern 5 shows a "periodic strokes" state, where the person in bed is having periodic strokes.

The in-bed state determination section 3 determines at least one of the above-mentioned states based on the detected load signal. The in-bed state determination section 3 may include a first table, against which one of the above states is to be determined based on the amplitude and frequency of the detected load signal. For example, the first table may indicate that a pattern satisfying the condition "$A_1 \leqq$amplitude of the detected load signal$<A_2$" and the condition "$C_1 \leqq$frequency of the detected load signal$<C_2$" is pattern 2. In this case, the in-bed state determination section 3 determines that a person in bed whose sensed motion satisfies these conditions is in a "lacking sleep" state. Alternatively, the in-bed state determination section 3 may detect movement of the person in bed based on the magnitude of the absolute value of the detected load signal, and determine one of the above states based on the temporal distribution of the detected load signal.

Although the load detection section 2 in FIG. 1 may be disposed between a caster on a leg of the bed and the floor, a mechanism for detecting a load applied to a leg of the bed may alternatively be provided within the leg.

The in-bed state determination section 3 and the signal transmission section 4 may be implemented as one integral means.

EXAMPLE 2

An in-bed state detection system 20 according to a second example of the present invention will be described with reference to the figures.

Figure 4:
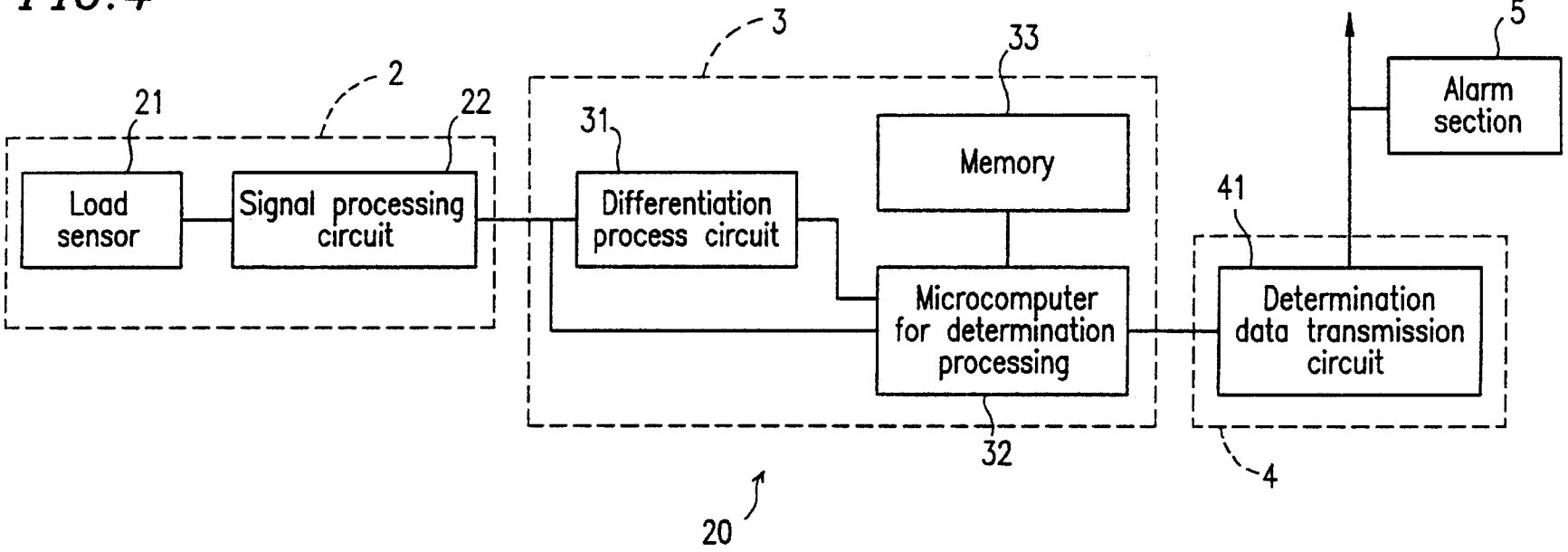
FIG. 4 is a diagram illustrating an in-bed state detection system according to Example 2 of the present invention.

FIG. 4 is a diagram illustrating the in-bed state detection system 20. The in-bed state detection system 20 includes a load detection section 2, an in-bed state determination section 3, and a transmission section 4.

The load detection section 2 includes a load sensor 21 and a signal processing circuit 22. The load sensor 21 can be implemented based on a strain resistor, a load cell, or a modified coil spring. The load sensor 21 detects the load applied to a leg of a bed 1. The signal representing the detected load is shaped by the signal processing circuit 22, and sent to the in-bed state determination section 3 as a load signal.

The in-bed state determination section 3 includes a microcomputer 32 (including an A/D convertor) for determination processing, and a memory 33. The microcomputer 32 receives the load signal from the signal processing circuit 22 and determines the in-bed state based thereon.

The memory 33 stores a comparison threshold value or a table as required for the determination of the in-bed state.

The in-bed state determination section 3 may include a differentiation process circuit 31 as illustrated in FIG. 4. In the case where the in-bed state determination section 3 includes a differentiation process circuit 31, the differentiation process circuit 31 receives a load signal and subjects the load signal to differentiation by time, so as to send a resultant signal (hereinafter "differentiation signal") to the microcomputer 32. The microcomputer 32 receives the differentiation signal and determines the in-bed state based thereon. Alternatively, the microcomputer 32 may determine the in-bed state based on the load signal.

The differentiation of the load signal may be performed in the microcomputer 32 instead of the differentiation process circuit 31.

Hereinafter, the temporal relationship of the waveform (pulses) obtained by differentiating a load signal by time will be described with respect to various in-bed states.

Figure 5:
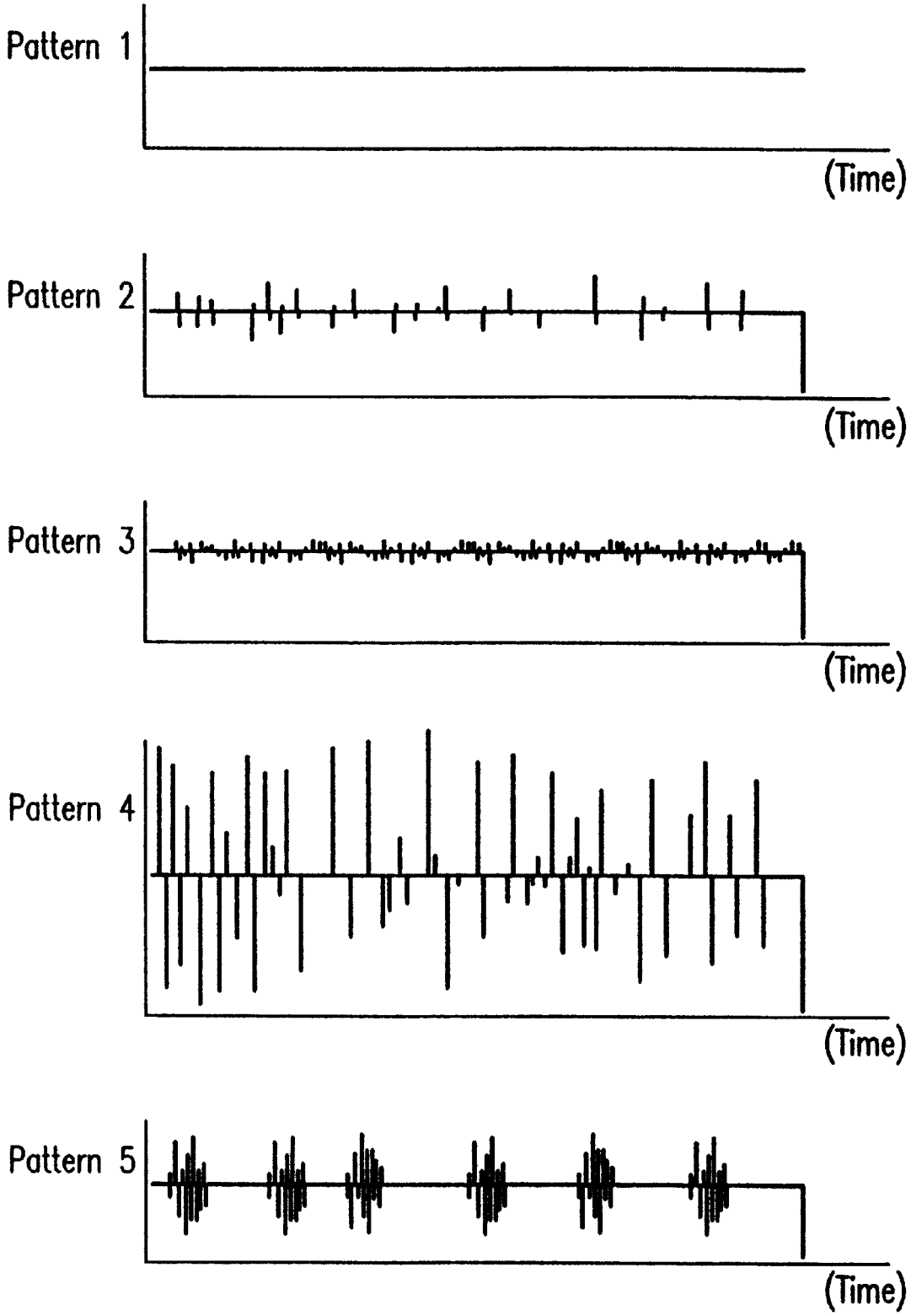
FIG. 5 is a set of graphs illustrating exemplary waveforms versus time in various in-bed states, where the waveforms are obtained by differentiating a load signal by time.

FIG. 5 is a set of graphs illustrating exemplary waveforms versus time in various in-bed states, where the waveforms are obtained by differentiating a load signal by time. In FIG. 5, pattern 1 shows a "fast asleep" state; pattern 2 shows a "lacking sleep" state; pattern 3 shows a "convulsive" state; pattern 4 shows a "frantic" (under an unperiodic stroke) state; and pattern 5 shows a "periodic strokes" state.

The microcomputer 32 determines at least one of the above-mentioned states based on the waveform (pulses) obtained by differentiating the load signal by time via the differentiation process circuit 31. The memory 33 may include a second table against which the microcomputer 32 determines at least one of the above-mentioned patterns based on the output intensity and temporal distribution of the pulses. For example, the second table may indicate that a pattern satisfying the condition "$I_1 \leqq$output intensity$<I_2$" and the condition "$D_1 \leqq$temporal distribution density$<D_2$" is pattern 2. In this case, the microcomputer 32 determines that a person in bed whose sensed motion satisfies these conditions is in a "lacking sleep" state. Specifically, the microcomputer 32 calls the table stored in the memory 33 to compare the output intensity and the temporal distribution of the aforementioned pulses against the table, thereby determining a state which corresponds to the specific output intensity and temporal distribution of the pulses.

Alternatively, the microcomputer 32 may detect the in-bed state based on the differentiation signal and the load signal. Such an in-bed state detection system can accurately determine the in-bed state. In this case, the memory 33 includes the first table (according to Example 1) as well as the second table.

The results determined by the microcomputer 32 are output by a determination data transmission circuit 41 in the transmission section 4 (FIG. 4) to a designated location outside of the room in which the bed 1 is placed. The result of determination by the microcomputer 32 may be a digital value.

Optionally, the in-bed state detection system 20 may include an alarm section 5. The alarm section 5 indicates the in-bed state of a person to another via sounds (defined herein as encompassing any audible sounds including voices, etc.) and/or light, based on the result of determination by the microcomputer 32. The indication or alarm via sounds and/or light can be continuous or intermittent. The in-bed state detection system 20 may also include an alarm disengagement section for stopping the alarm after the in-bed state of the person in bed has been confirmed by another.

The load sensor 21, e.g., a load cell, may be disposed between a caster on a leg of the bed and the floor. Alternatively, a mechanism for detecting a load applied to a leg of the bed may alternatively be provided within the leg.

The in-bed state determination section 3 and the signal transmission section 4 may be implemented as one integral means.

EXAMPLE 3

An in-bed state detection system 50 according to a third example of the present invention will be described with reference to the figures.

Figure 6:
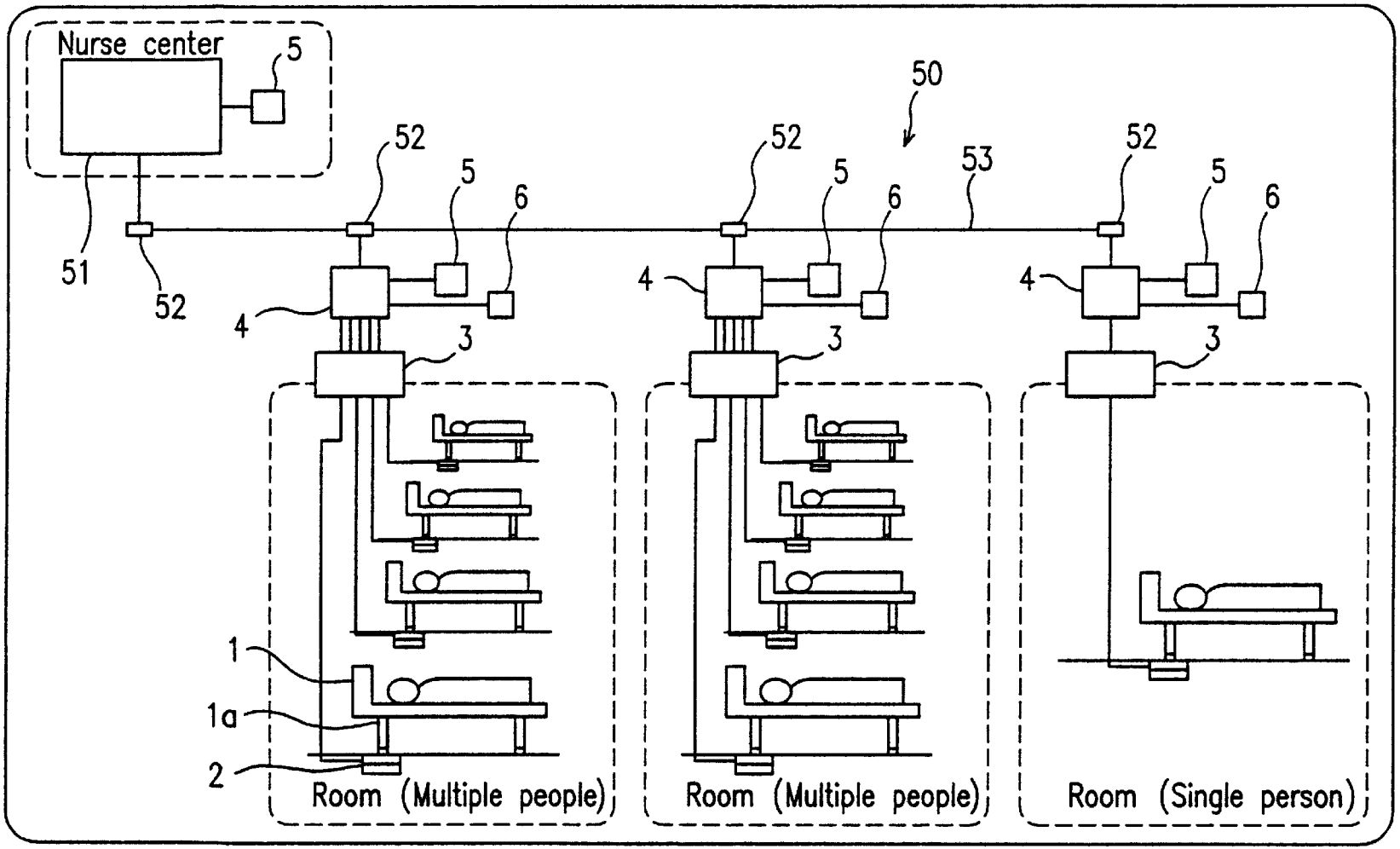
FIG. 6 is a diagram illustrating an in-bed state detection system according to Example 3 of the present invention.

FIG. 6 is a diagram illustrating the in-bed state detection system 50. The in-bed state detection system 50 includes load detection sections 2, in-bed state determination sections 3, transmission sections 4, alarm sections 5, alarm disengagement sections 6, and a central control unit 51. The load detection sections 2, the in-bed state determination sections 3, the transmission sections 4, the alarm sections 5, and the alarm disengagement sections 6 are of the same construction as that of their corresponding components in Examples 1 and/or 2. It is assumed that the in-bed state detection system 50 is installed in a hospital, a facility for the aged, etc., having a plurality of rooms, with the central control unit 51 being located in a room other than any of the rooms accommodating one or more beds.

Each load detection section 2 is located in a bed room accommodating at least one bed. More specifically, the load detection section 2, which detects the load applied on at least one leg (i.e., leg 1*a*) of the bed 1, is disposed between that leg and the floor. All or part of the load detection section 2 is located inside or outside the room. As in Examples 1 and 2, each in-bed state determination section 3 is capable of determining the respective in-bed states based on load signals output from a plurality of load detection sections 2. The results of determination are sent by each transmission section 4 to the outside of the corresponding room. Specifically, the results of determination are sent to the central control unit 51 via an IFU (interface unit) 52 and wiring 53 (e.g., Ethernet). The central control unit 51 includes a monitor (not shown) indicating the in-bed states of the respective patients. The central control unit 51 may be located in a nurse station for monitoring the patients. Nurses, doctors, and others standing by in the nurse station can know the in-bed states of the respective patients in real time.

An alarm section 5 may be provided in the vicinity of the central control unit 51 for indicating the results of determination. The alarm section 5, using sounds and/or light, indicates any state that may be hazardous to the life of each patient, e.g., a "convulsive" state, a "frantic" (under an unperiodic stroke) state, or a "periodic strokes" state, to those standing by in the nurse station. The indication or alarm via sounds and/or light can be made continuously or intermittently.

The alarm disengagement sections 6 for stopping the alarm may be located in a hallway between the nurse station and the rooms accommodating beds for patients. Thus, once a doctor, a nurse, or the like, has directly confirmed the state of a patient, he or she can stop the alarm indicated by the alarm section 5 via the alarm disengagement section 6 located in the hallway, without returning to the nurse station.

Optionally, monitor cameras or the like (not shown) for indirectly monitoring the states of the respective patients may be provided in each room. The central control unit 51 may be provided with a function of stopping alarms. Thus, once a doctor, a nurse, or the like has confirmed the safe condition of a patient via images from a monitor camera displayed on a monitor display located in the nurse center or the like, he or she can stop the alarm by means of the central control unit 51.

Furthermore, the monitor cameras and the monitor display may be arranged so as to automatically begin displaying a patient who has entered a state that may be hazardous to the life of each patient, e.g., a "convulsive" state, a "frantic" (under an unperiodic stroke) state, or a "periodic strokes" state.

Figure 7:
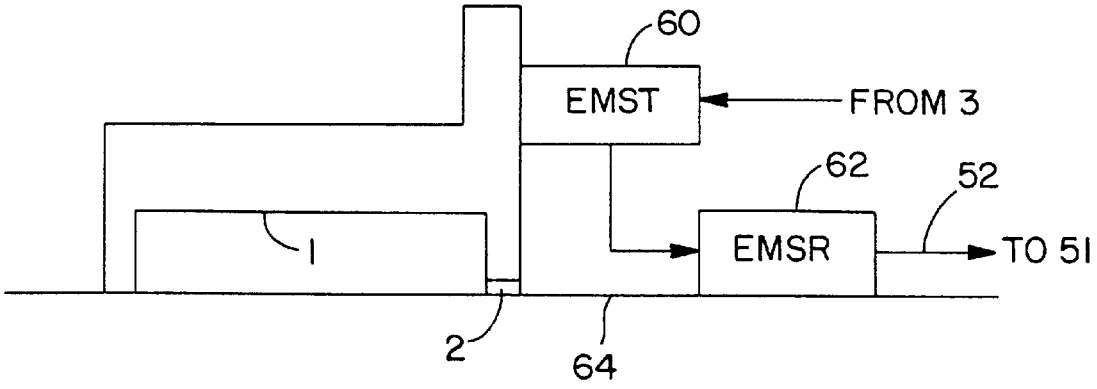
FIG. 7 is a diagram illustrating an in-bed state detection system according to Example 4 of the present invention.

As the transmission section 4 for transmitting results of determination by the in-bed state determination section 3 to the outside, as shown in FIG. 7 an electromagnetic signal transmitter (EMST) 60 and an electromagnetic signal receiver (EMSR) 62 may be used. Such an electromagnetic signal transmitter may be disposed on the bed frame or the bed body 1. The electromagnetic signal transmitter receives the result of determination from the in-bed state determination section 3 and transmits it to the electromagnetic signal receiver disposed, for example, on the ceiling, wall, or the floor 64 of the room. The result of determination received by the electromagnetic signal receiver is sent to the central control unit 51 via the IFU 52. This arrangement allows for a substantially unrestricted layout of beds within each room.

In Examples 1 to 3, the load which is applied to at least one leg of the bed is detected. Therefore, it will be appreciated that the in-bed state detection system of the present invention can detect the load applied to each of any two or more legs of the bed and determine the in-bed state based on these load values.

The in-bed state detection system according to the present invention determines the in-bed state of a person in bed based on a detected load signal, and transmits the result of determination to the outside of the room in which the bed is placed. This eliminates the need for another person to stand by in the room in order to monitor the state of the person who is in bed.

The in-bed state detection system according to the present invention can include an alarm section for indicating or alarming any of the aforementioned in-bed states via sounds and/or light. Therefore, even if a patient encounters a stroke or convulsion so that he or she cannot even utter a sound for help, the alarm section can call for help instead of the patient.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An in-bed state detection system comprising:

a load detection section adapted for placement between a bed and a floor on which the bed is placed for detecting a load applied to the bed and providing a corresponding load signal;

a determination section for determining an in-bed state based on the load signal; and a transmission section for transmitting a result of the determination, wherein the determination section differentiates the load signal by time and determines the in-bed state based on an output intensity and temporal distribution of a signal resulting from differentiation of the load signal.

2. An in-bed state detection system according to claim 1 further comprising means for indicating the in-bed state via sounds and/or light.

3. An in-bed state detection system according to claim 1, wherein the transmission section includes an electromagnetic signal transmitter and an electromagnetic signal receiver, the electromagnetic signal transmitter being disposed on the bed, and the electromagnetic signal receiver being disposed at a location other than on the bed.

4. An in-bed state detection system according to claim 1, wherein the in-bed state is at least one of a "fast asleep"

state, a "lacking sleep" state, a "convulsive" state, a "frantic" state, and a "periodic strokes" state.

5. An in-bed state detection system according to claim 1, further comprising a central control unit for receiving the result of the determination transmitted from the transmission section and displaying the result, the central control unit being disposed in a room other than a room in which the bed is placed.

6. An in-bed state detection system according to claim 1, wherein said transmission section includes an electromagnetic signal transmitter and an electromagnetic signal receiver adapted to be disposed at spaced apart locations.

7. An in-bed state detection system according to claim 1, wherein the determination section determines the in-bed state based on an amplitude and a frequency of the load signal.

8. A bed having an in-bed state detection system comprising:

a bed;

a load detection section between said bed and a floor on which said bed is placed for:

(a) detecting a load applied to said bed, and (b) supplying a load signal representative of the load applied to said bed;

a determination section for determining an in-bed state based on the load signal; and a transmission section for transmitting a result of the determination, wherein the determination section differentiates the load signal by time and determines the in-bed state based on an output intensity and temporal distribution of a signal resulting from differentiation of the load signal.

9. A bed according to claim 8, wherein said transmission section includes an electromagnetic signal transmitter and an electromagnetic signal receiver disposed at spaced apart locations.

10. A bed according to claim 9, wherein said electromagnetic signal transmitter is disposed on said bed.

11. A bed according to claim 9, wherein said electromagnetic signal receiver is disposed on one of the ceiling, the wall and the floor of the room in which said bed is located.

* * * * *